US006192871B1

(12) United States Patent
Middlebrook

(10) Patent No.: US 6,192,871 B1
(45) Date of Patent: Feb. 27, 2001

(54) COMPACT SUPERCHARGER

(75) Inventor: James K. Middlebrook, Moorpark, CA (US)

(73) Assignee: Vortech Engineering, Inc., Channel Islands, CA (US)

( * ) Notice: Subject to any disclaimer, the term of this patent is extended or adjusted under 35 U.S.C. 154(b) by 0 days.

(21) Appl. No.: 09/183,066

(22) Filed: Oct. 30, 1998

(51) Int. Cl.[7] ..... F02B 33/00

(52) U.S. Cl. ..... 123/559.1; 123/196 R; 184/6.26

(58) Field of Search ..... 123/559.1, 196 R; 184/6.26; 11/11

(56) References Cited

U.S. PATENT DOCUMENTS

| | | | | |
|---|---|---|---|---|
| 2,667,049 | * | 1/1954 | Guernsey et al. | 123/559.1 |
| 3,625,310 | | 12/1971 | Herrick | 184/6.12 |
| 3,650,353 | | 3/1972 | Abbott | 184/6.12 |
| 4,630,711 | | 12/1986 | Levrai et al. | 184/6.12 |
| 4,879,921 | | 11/1989 | Asada et al. | 74/467 |
| 5,224,459 | * | 7/1993 | Middlebrook | 123/559.1 |
| 5,467,667 | | 11/1995 | Zaiser et al. | 74/606 |
| 5,715,912 | * | 2/1998 | Maxwell et al. | 184/6.26 |
| 6,045,092 | * | 4/2000 | Foster | 244/134 C |

FOREIGN PATENT DOCUMENTS

| | | |
|---|---|---|
| 0530133 | 3/1993 | (EP) . |
| 2147064 | 5/1985 | (GB) . |
| WO 8902536 | 3/1989 | (WO) . |

* cited by examiner

*Primary Examiner*—Noah P. Kamen
(74) *Attorney, Agent, or Firm*—Christie, Parker & Hale, LLP

(57) ABSTRACT

A compact supercharger having a drive portion, and an atomizer for providing a lubricating oil/air mist to the supercharger. The drive portion has a drive gear with teeth and an outer circumference and a driven gear with teeth and an outer circumference, drive gear bearing races and driven gear bearing races, and a gear case with an inner chamber with a back wall, a front wall, perimeter walls having a swale formed thereon. Drive gear bearing mounting recesses receive the drive gear bearing races, and driven gear bearing mounting recesses receive the driven gear bearing races. An oil/air mist inlet is formed in the gear case, and oil/air mist channels are in communication with the oil/air mist inlet and the driven gear bearing races. A splitter with passageways is located near a bottom of the gear case in the vicinity of an oil outlet. The outer circumference of the drive gear is in close proximity to the perimeter walls of the inner chamber and an upper face of the separator portion. During rotation of the drive gear, oil/air mist will be expelled against the perimeter wall portion to aid in separating the air from the oil, the oil will travel down the swale, through the passageways of the splitter, and exit through the oil outlet, thereby preventing windage of the oil in the gear case and assisting in power draining of oil from the gear case.

29 Claims, 4 Drawing Sheets

2
5
4
26
52
108
110
68a
74a
72
90
92
68b
76
74b
102
60b
58b
24
88
84
86
64
56b
104
54b
50
46
22
90
52
78
42
70
60a
34
62
58a
44
56a
28
96
54a
32
26
80
16
20
18
14
12
10

COMPACT SUPERCHARGER

FIELD OF THE INVENTION

Supercharger for internal combustion engines, and more particularly a low profile supercharger having an oil misting lubrication system and a power drain system for expelling oil out of the case after the oil has lubricated the supercharger.

BACKGROUND OF THE INVENTION

Supercharging of internal combustion engines is a well-established method of obtaining greater power output from engines of a given size. Due to the extremely high rotational speeds of the compressor, gears, bearing races, and other moving parts of superchargers, it is imperative to maintain adequate lubrication in superchargers. In addition to preventing excessive wear of parts, lubrication aids in cooling of the parts.

In present superchargers, lubrication slingers are commonly used to provide lubrication to the moving part. See for example U.S. Pat. No. 5,638,796 to Adams, III et al., which discloses an electric supercharger with a lubrication slinger, and U.S. Pat. No. 4,171,137 to Aizu et al., which discloses a slinger arrangement for use with the bearing of superchargers. Others indicate, in a general manner, that some oil will be kicked up by the slinging and create an oil mist that will tend to provide some lubrication. See for example U.S. Pat. No. 5,281,116 to Gwin, U.S. Pat. No. 5,241,932 to Everts, U.S. Pat. No. 4,423,710 to Williams, and U.S. Pat. No. 5,579,735 to Todero et al. U.S. Pat. No. 4,752,193 to Hörler discloses using the venturi effect created by a turbocharger to aid in evacuating oil that collects at the bottom of the supercharger's gear case.

U.S. Pat. No. 5,375,573 to Bowman disclosing a two-stroke internal combustion engine having a pressurized air rail. The pressurized air rail is for producing an atomized fuel spray for injection into the individual combustion chambers, in which oil for lubrication is atomized by metering it into a stream of compressed air taken from the rail or a reservoir connected thereto and the resulting oil/air mist is injected into the crankcase and/or the lower part of the cylinder selectively and directly onto points requiring lubrication. Bowman discloses that to reduce the load on the air compressor feeding the pressurizing rail, the compressed air supply for the oil atomization may be supplemented by an engine supercharger, if one is utilized. Bowman further states that each cylinder of the engine is provided with a plurality of lubricating jets or nozzles to generally direct atomized oil locally to easily accessible parts and components in a two stroke engine such as the small-end bearings, big-end bearings, the piston skirt and piston ring areas. Bowman does not disclose use of a misting oil/air system for lubricating supercharger bearings, or using a misting oil/air system for lubricating less accessible components such as bearing races press fitted into bearing race cavities in superchargers.

Superchargers are frequently belt driven and have gears in a gear case to substantially gear up the rotational speed so that the compressor of the supercharger will generate sufficient boost. In presently available superchargers, the space inside the gear case is purposely made relatively large, with much space between the gears and the walls of the gear case so that oil can be flung onto the various gears and bearings. However, one side effect of large cases is that oil that accumulates in the bottom of the case to be drained is sometimes whipped up by the gears and become foamy. This foamed oil hinders drainage, and as a result the oil will increase in temperature, and lower the performance of the supercharger.

Although there has been a substantial amount of development work on more efficient designs for superchargers, there remains a need for improved superchargers that are more compact in design, are better lubricated, and that are more durable, more efficient, and readily installable onto different engines.

BRIEF DESCRIPTION OF THE INVENTION

The inventor has developed a supercharger that includes certain features that significantly improve the lubrication of its gears and which provides a low profile supercharger. The supercharger unit itself takes filtered air, preferably from a cool location, in from the center of the compressor wheel which has radial vanes and which accelerate the air. The air, leaving the impeller, is diffused and slowed, thus compressing it before discharging the air essentially tangentially with respect to the vanes. The compressor wheel is located in a shallow bore which is of a depth to receive the base or vane supporting part of the compressor wheel such that the air from the compressor wheel flows smoothly into the volute with no abrupt discontinuity or drop off to create turbulence or eddies.

The supercharger includes a drive shaft that carries an external pulley driven by the associated engine. The drive shaft extends into a drive portion of the supercharger. The drive portion has a gear case containing a larger drive gear that meshes with and drives a smaller driven gear. The gear case has an inner chamber with a back wall, a front wall, and perimeter walls having a swale formed thereon. Rolling elements (ball) drive gear bearing mounting recesses receive drive gear bearing races (or other rolling elements), and driven gear bearing mounting recesses receive driven gear bearing races (or other rolling elements). The driven gear is connected to the compressor through a driven shaft. Both the drive and the driven gears can be standard with the gears representing about a 3.45:1 ratio for increased rotational speed of the compressor wheel, relative to engine speed, and both the drive and driven shafts are carried by bearing races. Of course, other gear ratios can be used.

The compact supercharger preferably also includes an atomizer for providing a lubricating oil/air mist to the supercharger. One advantage of using an oil/air mist for lubricating the driven gear bearing assemblies is that the oil can be readily sprayed into the bearings, thereby achieving quick and excellent penetration. Further, the pressurized air atomizes the oil and improves distribution and will also assist in driving the oil out of the gear case after it is used, thereby shorting the cycle time of the oil in the gear case, and providing improved lubrication and cooling of the gear case. An oil/air mist inlet is formed in the gear case, and oil/air mist channels are in communication between the oil/air mist inlet and the driven gear bearing races. A splitter with passageways is located near a bottom of the gear case in the vicinity of an oil outlet. The outer circumference of the drive gear is in close proximity to the perimeter walls of the inner chamber and an upper face of the separator portion. During rotation of the drive gear, oil/air mist will be expelled against the perimeter wall portion to aid in separating the air from the oil, the oil will travel down the swale and groove, through the passageways of the splitter, and exit through the oil outlet, thereby preventing windage of the oil in the gear case and assisting in power draining of oil from the gear case. Alternately, the supercharger can be used simply with pressurized oil rather than an oil/air mist, in which case oil alone will travel through the channels and be dispelled onto the bearing races.

BRIEF DESCRIPTION OF THE DRAWINGS

This invention may be more clearly understood from the following detailed description and by reference to the drawing in which.

DETAILED DESCRIPTION OF THE INVENTION

Figures 1, 3, 6:
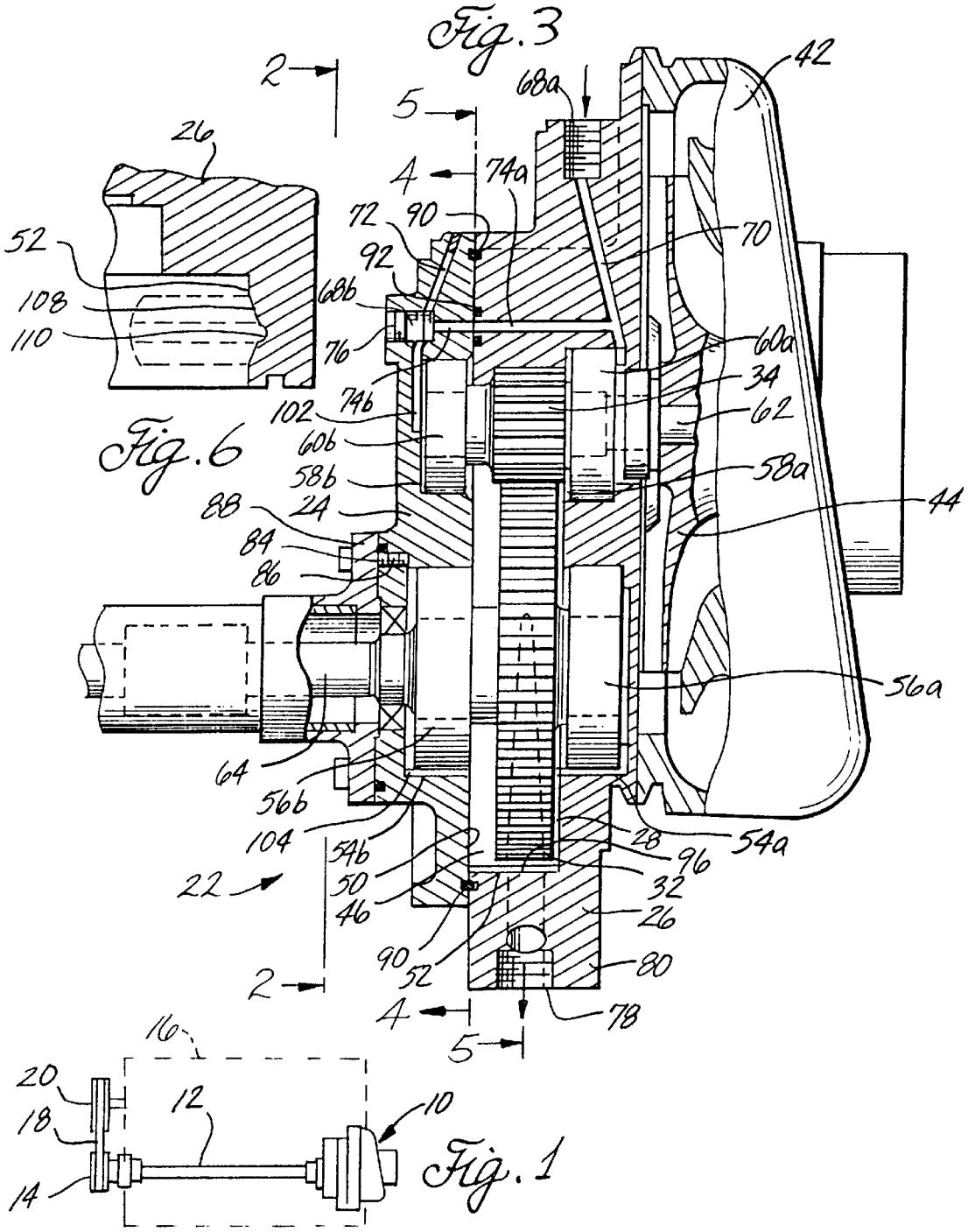
FIG. 1 is a front perspective showing a supercharger, its drive shaft, and pulley arrangement attached to an engine.
FIG. 3 is a partial cross-sectional view along lines 3—3 of FIG. 2 showing details of supercharger.
FIG. 6 is a cross-section view through view lines 6—6 of FIG. 5 showing the swale and groove on the perimeter walls of the back portion of case.

Referring to FIG. 1, a front perspective view of the supercharger 10 of the invention and its drive input 12 with its attached pulley 14 shown attached to a part of the engine 16 and driven by a belt 18 connected to an engine pulley 20. While the drive input 12 is shown as relatively long, it can be relatively short so that the supercharger 10 will be placed in close proximity to the engine pulley 18, or can be used without an extended drive and the pulley can be placed directly on the supercharger. The inventor's co-pending patent application "Drive Extender for Supercharger" further discusses an elongate drive input that permits superchargers to be displaced a substantial distance away from the engine's belts and pulleys.

Figure 2:
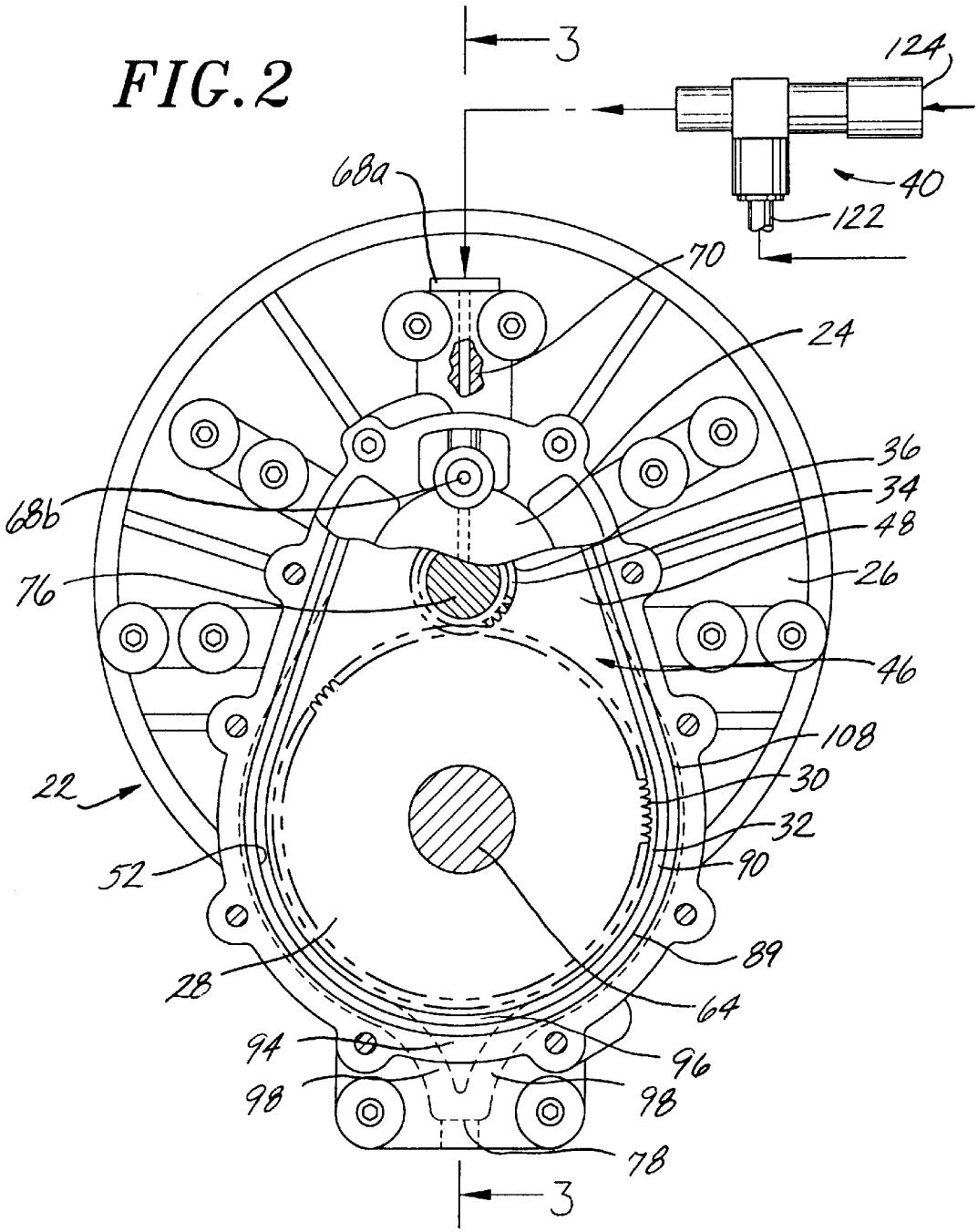
FIG. 2 is a front top partially cut-away perspective of a gear case of the supercharger showing the gears and internal structure.

FIG. 2 is a front top partially cut-away perspective of a gear case 22 of the supercharger 10 showing gears and its internal structure. Cover of gear case 24 is partially broken away from the back portion 26 of gear case 24 to show drive gear 28 with its teeth 30 and outer circumference 32 and driven gear 34 with its teeth 36 and outer circumference 38. Circumference 32 of drive gear 28 is larger than the circumference 38 of driven gear 34. An atomizer 40 is attached to gear case 22.

FIG. 3 is a partial cross-sectional view of supercharger 10 along lines 3—3 of FIG. 2 showing additional details. Supercharger 10 has a volute 42 and a compressor wheel (impeller) 44 positioned in the volute 42 that make up the compressor. When placed together, back portion 26 of gear case and cover 24 of gear case define an inner chamber 46 with a back wall 48, a front wall 50, perimeter walls 52, drive gear bearing mounting recesses 54*a* and 54*b* to receive drive gear bearing races 56*a* and 56*b* (or other known bearing means), and driven gear bearing mounting recesses 58*a* and 58*b* to receive driven gear bearing races 60*a* and 60*b* (or other known bearing means). Driven gear 34 is connected to an impeller-carrying shaft 62 to which impeller 44 is attached. Power to drive the supercharger 10 is supplied by a drive gear shaft 64 connected to drive gear 28. For purposes of reference, gear case 22 and its associated gears 28 and 34, bearing races 56*a* and 56*b* and 60*a* and 60*b*, and shafts 62 and 64 are referred to as the "drive portion" 66 of the supercharger. At least one oil inlet 68 is formed in gear case 22 to receive engine oil (either in an oil/air mist supplied by atomizer 40, or simply oil if no atomizer is used.) For greater versatility, oil inlets 68*a* and 68*b* can be formed in cover 24 and back portion of case 26, respectively. A channel 70 is formed in back portion of case 16 in communication between oil inlet 68*a* and the driven gear bearing mounting recess 58*a*, and a channel 72 is formed in cover of case 24 in communication between oil inlet 68*b* and the driven gear bearing mounting recess 58*b*. Channels 70 and 72 preferably communicate with each other via aligned channel sections 74*a* and 74*b* joining the two so that no matter which inlet 68*a* or 68*b* oil/air mist via atomizer 40 (or simply pressurized oil if no atomizer is used) is connected to, both sets of bearing races 60*a* and 60*b* in recesses 58*a* and 58*b* will be adequately lubricated. The inlet 68*a* or 68*b* not used will be plugged, such as with a bolt 76 or other means. An oil outlet 78 is formed at the bottom 80 of the gear case 22. An oil drain hose (not shown) connects to oil outlet 78 and connects to the oil pan of the vehicle (not shown). Cover of case 24 has a flat face 84, which is perpendicular to the axis of drive gear shaft 64. Bolt holes 86 are formed on face. A flange 88 also with a flat face of drive input 12 ensures accurate alignment of drive gear shaft 64 when bolted thereto. As shown, drive gear 28 has a larger circumference than driven gear 34 and drive gear 28 is positioned in gear case 22 below driven gear 34. The teeth of drive gear 28 and driven gear 34 mesh together.

Turning again to FIG. 2, a groove 88 is formed in back portion of case 26 into which an O-ring 90 fits to provide a tight seal between cover of case 24 and back portion of case 26.

Turning again to FIG. 3, a small O-ring 92 provides sealing between channel sections 74*a* and 74*b*.

Figure 4:
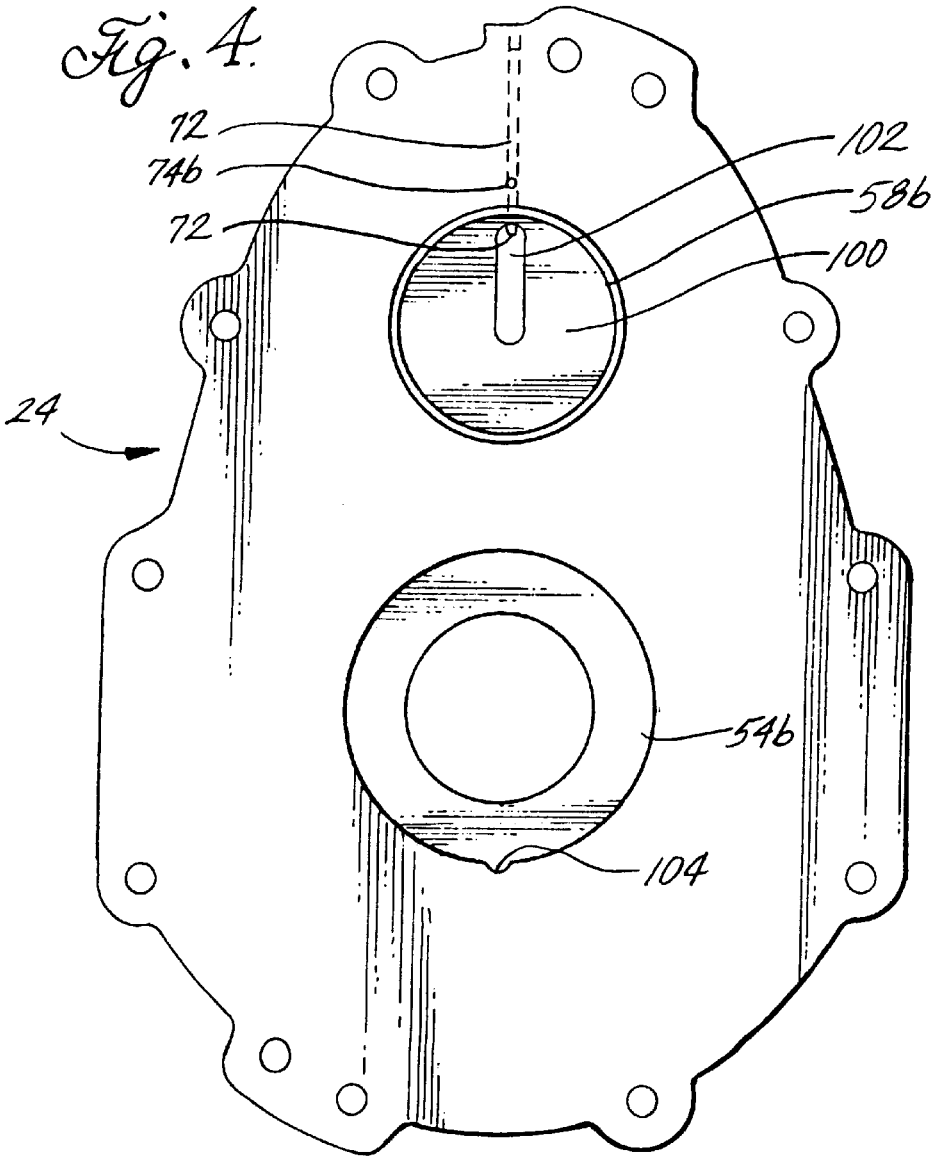
FIG. 4 is a rear perspective view of the inside of the cover of the gear case.

Referring now to FIG. 4, a rear perspective view of cover of the gear case 24 is shown. Formed on a back wall 100 of recesses 58*b* is a slot 102. Channel 72 communicates with slot 102, and slot 102 helps to distribute the oil or oil/air mist onto bearings (not shown). A groove 104 is formed at the bottom region of recesses 54*b*. Groove 104 aids in draining oil from drive bearing (not shown).

Figure 5:
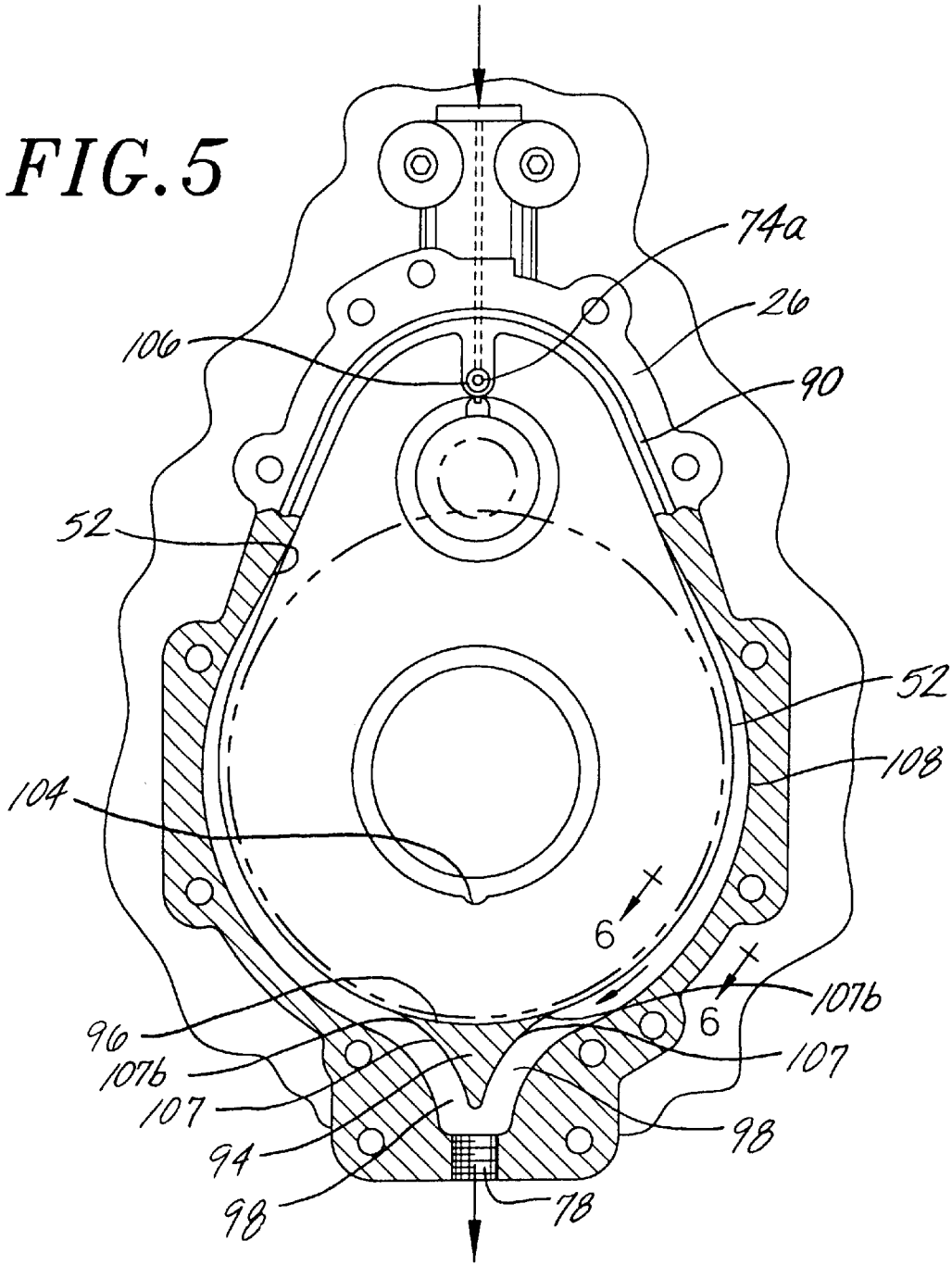
FIG. 5 is a partially cut-away perspective view of the back portion of the gear case with gears and bearings removed.

FIG. 5 is a partially cut-away and perspective view of back portion of gear case 26 with gears and bearings removed to show details and with the lower part of the back portion of gear case 26 cut away. An O-ring receiving groove 104 is formed around channel section 74*a* to receive O-ring 92 (as shown in FIG. 3) to form a liquid tight seal of channel sections 74*a* and 74*b*. A splitter 94 is located near a bottom of the back portion of gear case near the oil outlet 78. Splitter 94 has a curved upper face 96 that is in close proximity to the outer circumference 32 of drive gear 28, and passageway 98 communicating with oil outlet 78. Splitter 94 is located near a bottom of the back portion of gear case near the oil outlet 78. Splitter 94 preferably also has concavely curved inner side walls 106, but they could also be straight. Leading edges 106*b* are formed on the face of splitter 94. Perimeter walls 52 have a swale 108 formed along at least a portion of perimeter walls 52 in the vicinity of the portion of the case receiving the drive gear (not shown). Swale 108 extends into passageways of the splitter. Swale 108 also preferably has groove 110 formed thereon.

FIG. 6 is a cross-section view through view lines 6—6 of FIG. 5 showing swale 108 and groove 110 on the perimeter walls 52 of the back portion of case 26. Referring again to FIGS. 5 and 6, swale 108 and groove 110 help direct the oil thrown off of drive gear 28 and onto perimeter walls 52 downward. During rotation of drive gear 26, oil or oil/air mist will be expelled against the swale 108 of perimeter wall 52 (and thereby help separate the air from the oil), travel down the swale and groove 110 of perimeter walls 52, and exit through oil outlet 78, thereby preventing windage of the oil in gear case 22. An oil drain hose (not shown) is connected to oil outlet 78 for connection back to the engine's oil supply. The concavely curved inner side walls 106 of splitter 94 (which could also be straight), in combination with the rotation of drive gear 28 will helps ensure that oil is propelled downward and outward of oil outlet 78 rather than spinning around the gear case 22. Obviously, drive gear 28 can rotate in a clockwise or counterclockwise direction (since properly configured, either direction can generate boost for the supercharger.) For clockwise rotation of drive gear 28, oil will mostly be propelled down the right side of passageway 98, and for counterclockwise rotation of drive gear 28, oil will mostly be propelled down the left side of passageway 98. Since the rotational speed of the drive gear 28 and its bearing races 56*a* and 56*b* are considerably slower, direct point lubrication as described above with respect to the driven gear bearing races 60*a* and 60*b* and driven gear 34 has not been found to be necessary. The oil being splashed from the driven gear 34 adequately provides lubrication of the drive gear 28 and drive gear bearing races 56*a* and 56*b* 34 and driven gear bearing races 60*a* and 60*b*.

Figure 7:
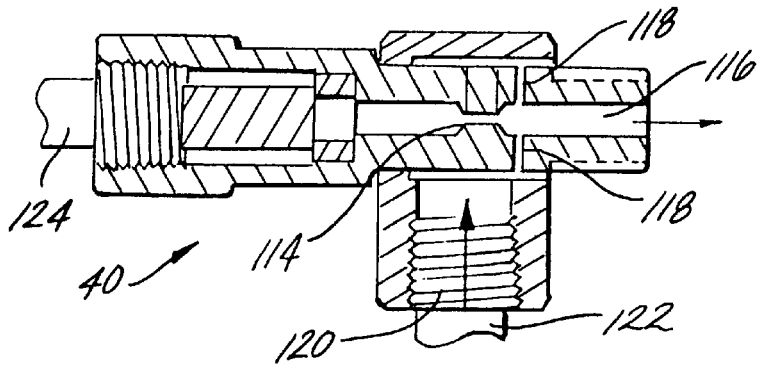
FIG. 7 is a cross-sectional view of the oil/air atomizer.

FIG. 7 is a cross-sectional view of the oil/air atomizer 40. Atomizer has an oil inlet end 112, an oil jet 114, a downstream channel 116, and at least one and preferably two or more pressurized air aperture 118 formed into the downstream channel 116. Pressurized air is supplied to the air apertures 118 via a pressurized air inlet 120. The pressurized air for the atomizer can preferably be supplied from the volute 42 of the supercharger 10 via a hose 122. The oil can be supplied via a hose 124 from the engine. The pressurized air merges with the oil to form an oil/air mist that exits an oil/air mist outlet end. The atomizer 40 can be directly connected to one of the oil/air mist inlets 68*a* or 68*b*, or the outputted oil/air mist can be delivered via a hose (not shown). Indeed, due the increased pressure provided by the air in the gear case.

As noted above, the supercharger 10 can be lubricated simply with pressurized oil rather than an oil/air mist, in which event oil alone (and not an oil/air mist) will travel through the channels and will be expelled onto the bearing races. The inventor has found that adding a swale 108 and the additional groove 110 in swale 108 on the perimeter improves the drainage. The benefits of using an air/oil mist are twofold. First, the pressurized air aids in expelling oil out of the gear case once used. Second, the oil/air mist assists the oil in permeating the bearing. Thus, using less oil, but with a quick throughput time, better cooling can be achieved. The splitter 94 also aids in the drainage of oil. All in all, the design provides a smaller yet more efficient gear case.

The above-described embodiments of the present invention are merely descriptive of its principles and are not to be considered limiting. The scope of the present invention instead shall be determined from the scope of the following claims including their equivalents.

I claim:

1. A compact supercharger having a volute, a compressor, and a drive portion, the drive portion comprising:

a drive gear having teeth and an outer circumference and a driven gear having teeth and an outer circumference, the driven gear having a shaft adapted to connect to the compressor;

drive gear bearing races and driven gear bearing races; and a drive gear having teeth and an outer circumference and a driven gear having teeth and an outer circumference, the driven gear having a shaft adapted to connect to the compressor;

drive gear bearing races and driven gear bearing races; and a gear case having an inner chamber with a back wall, a front wall, perimeter walls, drive gear bearing mounting recesses to receive the drive gear bearing races, driven gear bearing mounting recesses to receive the driven gear bearing races, at least one oil inlet in the gear case to receive engine oil, and oil channels in communication with the at least one oil inlet and the driven gear bearing races, and an oil outlet on the gear case; and a splitter located near a bottom of the gear case in the vicinity of the oil outlet, the splitter having leading edges in close proximity to the outer circumference of the drive gear, and passageway communicating with the oil outlet, wherein the outer circumference of the drive gear located in the gear case is in close proximity to at least portions of the perimeter walls of the inner chamber and the drive gear has a larger circumference than the driven gear and the drive gear is located in the inner chamber of the gear case below the driven gear, wherein during rotation of the drive gear, oil will be expelled against the perimeter wall portion, travel down the perimeter walls and exit through the oil outlet, thereby preventing windage of the oil in the gear case and assisting in power draining of oil from the gear case.

2. The compact supercharger of claim 1, wherein the perimeter walls have a swale formed along at least a portion of the perimeter walls in the vicinity of the drive gear.

3. The compact supercharger of claim 2, wherein the swale extends into the passageways of the splitter.

4. The compact supercharger of claim 2, wherein an additional groove is formed in at least a portion of the swale.

5. The compact supercharger of claim 1, wherein a slot is formed on a bottom of the drive gear bearing mounting recesses for oil drainage.

6. The compact supercharger of claim 1, wherein the gear case comprises a back portion and a cover portion, one oil inlet is formed in the back portion and one oil inlet is formed in the cover portion, and the oil channels communicate with each other, and oil is delivered to one of the oil inlets with the other oil inlet being plugged.

7. The compact supercharger of claim 1, wherein oil is splashed from the driven gear and driven gear bearing races onto the drive gear and drive gear bearing races.

8. The compact supercharger of claim 1, further comprising an atomizer for mixing lubricating oil and pressurized air to generate an oil/air mist which is fed into one of the oil inlets.

9. The compact supercharger of claim 8, wherein the atomizer comprises an oil inlet end, an oil jet, a downstream channel, and at least one pressurized air aperture formed in the downstream channel through which pressurized air is supplied to form an oil/air mist that exits an oil/air mist outlet end.

10. The compact supercharger of claim 8, wherein the pressurized air for the atomizer is supplied from the volute of the supercharger and is fed to the atomizer.

11. The compact supercharger of claim 9, wherein oil from the oil/air mist separates from the pressurized air, and the air aids in expelling oil out of the oil outlet in the gear case.

12. A compact supercharger having a volute, a compressor, a drive portion, and an atomizer for providing a lubricating oil/air mist to the supercharger, the supercharger comprising:

an atomizer for mixing lubricating oil and pressurized air to create an oil/air mist; and a gear case for the supercharger adapted to accommodate gears and bearing means, the gear case having at least one inlet for the oil/air mist from the atomizer, channels communicating between the at least one inlet therethrough and the bearing means, and an oil outlet for draining oil from the gear case, wherein the pressurized air for the atomizer is derived from the volute of the supercharger.

13. The compact supercharger of claim 12, wherein the atomizer comprises an oil inlet end, an oil jet, a downstream channel, and at least one pressurized air aperture formed in the downstream channel through which pressurized air is supplied to generate an oil/air mist that exits an oil/air mist outlet end.

14. The compact supercharger of claim 12, wherein the bearing means comprise driven gear bearing races positioned in driven gear bearing mounting recesses, the driven gear bearing races rotatably carrying a shaft with a driven gear and adapted to connect to the compressor, and wherein the channels communicate with the driven gear bearing races to provide direct lubrication of the driven bearing races by oil/air mist.

15. The compact supercharger of claim 14, wherein the gear case comprises a base portion with a first oil/air mist inlet, and a cover portion with a second oil/air mist inlet, and wherein the channels comprise tunnels formed in the base portion and cover portion of gear case, the tunnels being in communication with each other, the first and second oil/air mist inlets, and the driven gear bearing races, and wherein the atomizer is connected to one of the two oil/air mist inlets, and the oil/air mist inlet not receiving the atomizer is plugged.

16. The compact supercharger of claim 14, wherein the bearing means further comprises a drive gear and drive gear bearing races positioned in drive gear bearing race recesses of the supercharger, and wherein oil is supplied to the drive gear and drive gear bearing races by being splashed from the driven gear bearing races and driven gear.

17. The compact supercharger of claim 12, wherein the gears comprises a drive gear having teeth and an outer circumference and a driven gear having teeth and an outer circumference, wherein the bearing means comprises drive gear bearing races and driven gear bearing races, wherein the gear case has an inner chamber with drive gear bearing mounting recesses to receive the drive gear bearing races and driven gear bearing mounting recesses to receive the driven gear bearing races, the inner chamber further having a back wall, a front wall, perimeter walls, the perimeter walls having a swale formed along at least a portion of the perimeter walls in the vicinity of the drive gear, wherein the outer circumference of the drive gear is in close proximity to at least portions of the perimeter walls of the inner chamber, wherein during rotation of the drive gear, oil will be expelled against the perimeter wall portion, travel down the swale, and exit through the oil outlet, thereby preventing windage of the oil in the gear case and assisting in power draining of oil from the gear case.

18. The compact supercharger of claim 17, further comprising a splitter located near a bottom of the gear case in the vicinity of the oil outlet, the splitter having leading edges in close proximity to the outer circumference of the drive gear, and passageway communicating with the oil outlet.

19. The compact supercharger of claim 17, further comprising a groove formed in at least a portion of the swale.

20. The compact supercharger of claim 19, wherein the driven gear has a smaller circumference and is located in the gear case above the drive gear.

21. A compact supercharger having a volute, a compressor, a drive portion, and an atomizer for providing a lubricating oil/air mist to the supercharger, the drive portion comprising:

a drive gear having teeth and an outer circumference and a driven gear having teeth and an outer circumference, the driven gear having a shaft adapted to connect to the compressor;

drive gear bearing races and driven gear bearing races; and a gear case having an inner chamber with a back wall, a front wall, perimeter walls having a swale formed thereon, drive gear bearing mounting recesses to receive the drive gear bearing races, driven gear bearing mounting recesses to receive the driven gear bearing races, at least one oil oil/air inlet in the gear case to receive engine oil, and oil/air mist channels in communication with the at least one oil inlet and the driven gear bearing races, an oil outlet at the bottom of the gear case, and a splitter located near a bottom of the gear case in the vicinity of the oil outlet, the splitter having a curved upper face in close proximity to the outer circumference of the drive gear, and passageway communicating with the oil outlet, wherein the outer circumference of the drive gear located in the gear case is in close proximity to at least portions of the perimeter walls of the inner chamber and an upper face of the separator portion, wherein during rotation of the drive gear, oil/air mist will be expelled against the perimeter wall portion to aid in separating the air from the oil, the oil will travel down the swale, through the passageways of the splitter, and exit through the oil outlet, thereby preventing windage of the oil in the gear case and assisting in power draining of oil from the gear case.

22. The compact supercharger of claim 21, wherein an additional groove is formed in at least a portion of the swale.

23. The compact supercharger of claim 22, wherein the drive gear has a larger circumference than the driven gear and is located in the inner chamber of the gear case below the drive gear.

24. The compact supercharger of claim 23, wherein the atomizer comprises an oil inlet end, an oil jet, a downstream channel, and at least one pressurized air aperture formed in the downstream channel through which pressurized air is supplied from the volute of the supercharger to generate an oil/air mist that exits an oil/air mist outlet end.

25. A compact supercharger having a volute, a compressor, and a drive portion, the drive portion comprising:

a drive gear having teeth and an outer circumference and a driven gear having teeth and an outer circumference, the driven gear having a shaft adapted to connect to the compressor;

drive gear bearing races and driven gear bearing races;

a gear case having an inner chamber with a back wall, a front wall, perimeter walls, drive gear bearing mounting recesses to receive the drive gear bearing races, driven gear bearing mounting recesses to receive the driven gear bearing races, at least one oil inlet in the gear case to receive engine oil, and oil channels in communication with the at least one oil inlet and the driven gear bearing races, and an oil outlet on the gear case, wherein the outer circumference of the drive gear located in the gear case is in close proximity to at least portions of the perimeter walls of the inner chamber; and a splitter located near a bottom of the gear case in the vicinity of the oil outlet, the splitter having leading edges in close proximity to the outer circumference of the drive gear, and passageway communicating with the oil outlet, wherein during rotation of the drive gear, oil will be expelled against the perimeter wall portion, travel down the perimeter walls and exit through the oil outlet, thereby preventing windage of the oil in the gear case and assisting in power draining of oil from the gear case.

26. A compact supercharger having a volute, a compressor, and a drive portion, the drive portion comprising:

a drive gear having teeth and an outer circumference and a driven gear having teeth and an outer circumference, the driven gear having a shaft adapted to connect to the compressor;

drive gear bearing races and driven gear bearing races; and a gear case having an inner chamber with a back wall, a front wall, perimeter walls, drive gear bearing mounting recesses to receive the drive gear bearing races, driven gear bearing mounting recesses to receive the driven gear bearing races, at least one oil inlet in the gear case to receive engine oil, and oil channels in communication with the at least one oil inlet and the driven gear bearing races, and an oil outlet on the gear case, wherein the outer circumference of the drive gear located in the gear case is in close proximity to at least portions of the perimeter walls of the inner chamber and wherein the perimeter walls have a swale formed along at least a portion of the perimeter walls in the vicinity of the drive gear;

wherein during rotation of the drive gear, oil will be expelled against the perimeter wall portion, travel down the perimeter walls and exit through the oil outlet, thereby preventing windage of the oil in the gear case and assisting in power draining of oil from the gear case.

27. A compact supercharger having a volute, a compressor, a drive portion, and an atomizer for providing a lubricating oil/air mist to the supercharger, the supercharger comprising:

an atomizer for mixing lubricating oil and pressurized air to create an oil/air mist; and a gear case for the supercharger adapted to accommodate gears and bearing means, the bearing means comprise driven gear bearing races positioned in driven gear bearing mounting recesses, the driven gear bearing races rotatably carrying a shaft with a driven gear and adapted to connect to the compressor, the gear case having at least one inlet for the oil/air mist from the atomizer, channels communicating between the at least one inlet therethrough and the bearing means, and an oil outlet for draining oil from the gear case, wherein the channels communicate with the driven gear bearing races to provide direct lubrication of the driven bearing races by oil/air mist.

28. A compact supercharger having a volute, a compressor, and a drive portion, the drive portion comprising:

a drive gear having teeth and an outer circumference and a driven gear having teeth and an outer circumference, the driven gear having a shaft adapted to connect to the compressor;

drive gear bearing races and driven gear bearing races;

a gear case having an inner chamber with a back wall, a front wall, perimeter walls, drive gear bearing mounting recesses to receive the drive gear bearing races, the drive gear bearing mounting recesses having a slot formed on a bottom thereof for drainage of oil, driven gear bearing mounting recesses to receive the driven gear bearing races, at least one oil inlet in the gear case to receive engine oil, and oil channels in communication with the at least one oil inlet and the driven gear bearing races, and an oil outlet on the gear case, wherein the outer circumference of the drive gear located in the gear case is in close proximity to at least portions of the perimeter walls of the inner chamber, wherein during rotation of the drive gear, oil will be expelled against the perimeter wall portion, travel down the perimeter walls and exit through the oil outlet, thereby preventing windage of the oil in the gear case and assisting in power draining of oil from the gear case.

29. A compact supercharger having a volute, a compressor, and a drive portion, the drive portion comprising:

a drive gear having teeth and an outer circumference and a driven gear having teeth and an outer circumference, the driven gear having a shaft adapted to connect to the compressor;

drive gear bearing races and driven gear bearing races;

a gear case having an inner chamber with a back portion and a cover portion, drive gear bearing mounting recesses to receive the drive gear bearing races, driven gear bearing mounting recesses to receive the driven gear bearing races, one oil inlet formed in the back portion and one oil inlet formed in the cover portion of the gear case to receive engine oil, and oil channels in communication with the oil inlets and the driven gear bearing races, and an oil outlet on the gear case, with oil being delivered to one of the oil inlets with the other oil inlet being plugged, wherein the outer circumference of the drive gear located in the gear case is in close proximity to at least portions of the perimeter walls of the inner chamber, wherein during rotation of the drive gear, oil will be expelled against the perimeter wall portion, travel down the perimeter walls and exit through the oil outlet, thereby preventing windage of the oil in the gear case and assisting in power draining of oil from the gear case.

* * * * *